United States Patent [19]

Naruns et al.

[11] 4,265,579

[45] May 5, 1981

[54] BULK MATERIAL UNLOADER

[75] Inventors: Laimons Naruns, Pittsburgh; Dennis W. Terry, Coraopolis; Samuel K. Stellfox, Pittsburgh, all of Pa.

[73] Assignee: Dravo Corporation, Pittsburgh, Pa.

[21] Appl. No.: 52,621

[22] Filed: Jun. 27, 1979

[51] Int. Cl.[3] ..... B63B 27/00; B66B 9/20

[52] U.S. Cl. ..... 414/138; 414/624; 414/399; 414/786; 212/265

[58] Field of Search ..... 414/138, 139, 394, 487, 414/564, 569, 624, 786; 212/3, 8, 13, 70, 9

[56] References Cited

U.S. PATENT DOCUMENTS

| | | | |
|---|---|---|---|
| 376,655 | 1/1888 | Hulett | 212/9 |
| 1,010,291 | 11/1911 | McIntyre | 414/569 |
| 1,193,587 | 8/1916 | Miller | 212/3 |
| 3,091,353 | 5/1963 | Allard | 414/139 |
| 3,429,453 | 2/1969 | Kahle et al. | 212/8 |
| 3,866,769 | 2/1975 | Morey et al. | 414/394 |

*Primary Examiner*—L. J. Paperner
*Assistant Examiner*—L. E. Williams
*Attorney, Agent, or Firm*—Parmelee, Miller, Welsh & Kratz

[57] ABSTRACT

A bulk material unloader in which a clamshell bucket is suspended from a boom which is luffed from a position over the material to be unloaded through the vertical to a position over a bulk material receiving hopper. The hoists and/or the anchors for the bucket hold and close ropes are mounted on the unloader base on the opposite side of the hopper from the boom pivot such that the suspended length of the hold and close ropes is increased as the boom is luffed through the vertical and the bucket is thereby lowered into the hopper with the hoists remaining inactive until the bucket is in position to be opened and discharged with minimum dusting effect.

10 Claims, 4 Drawing Figures

BULK MATERIAL UNLOADER

BACKGROUND OF THE INVENTION

1. Field of the Invention

This invention relates to a method and apparatus for unloading bulk material from a container such as a barge or vessel with a clamshell bucket suspended from a boom which is pivotable through the vertical from a position over the barge to be unloaded to a position over a hopper for receiving the bulk material.

2. Prior Art

It is common practice to unload bulk material from barges or other vessels using clamshell buckets. Generally, these clamshell bucket unloaders are of two types: whirler cranes in which the bucket is suspended from a boom which is slewed in a horizontal plane to transfer the bucket from a position over the vessel to a discharge position over a hopper on shore, and trolley mounted buckets in which the bucket is suspended from a trolley which reciprocates along a fixed horizontal boom cantilevered over the vessel to vertically align the bucket with the hold of the vessel and the hopper on shore. The whirler cranes have a relatively long cycle time which limits their capacity to unload a vessel in a given time period while the trolley mounted bucket unloaders require extensive structure which makes them practical only for relatively large operations. Both the whirler cranes and trolley mounted buckets require playing out the bucket hold ropes if the bucket is to be lowered into the hopper during discharge to reduce "dusting" or pollution of the air with bulk material particles.

It has been suggested in U.S. Pat. No. 3,091,353 that a clamshell bucket can be suspended from a short boom depending from a parallelogram linkage which is operated by a hydraulic ram to place the pivot of the boom over the vessel to be unloaded. The depending boom is then pivoted by another hydraulic ram to reciprocate the bucket from a loading position over the hold to a discharge position over a hopper carried by the parallelogram linkage which feeds an extendable conveyor. Again, this unloader requires a massive structure and the hold ropes must be played out to discharge the bulk material inside rather than above the hopper.

U.S. Pat. No. 1,317,696 suggests an unloader in which a clamshell bucket is supported by a double boom frame which is luffed through the vertical by a pair of gears from a position on one side of the machine wherein the bucket is centered over a railroad car to be unloaded to a position on the other side of the vertical to center the bucket over a wagon in which the bulk material is deposited. When no wagon is available, the bucket can be raised to the vertical and the material deposited in a tilting hopper. In this arrangement the hold and close ropes for the bucket are reeved over sheaves on the axis of rotation of the crane arm such that there is no change in the suspended length of the ropes as the crane passes from the one side of the vertical to the other. For this reason and the fact that the bulk material is discharged into the hopper when the boom is vertical, the ropes must also be played out to empty the bucket inside the hopper and thus reduce dusting.

Other prior art of interest includes U.S. Pat. No. 1,010,291 in which a clamshell bucket is suspended from a boom which is luffed to align the bucket with a hopper; however, the boom is not luffed to or through the vertical and therefore the ropes must be played out to discharge bulk material inside the hopper. U.S. Pat. No. 3,429,453 discloses a crane installation for ships in which a hinged frame straddles the ship's hold and is luffed through the vertical by cables. It is stated that the load carrying hook can be maintained at a constant elevation by suitable controls as the boom is luffed.

It is a primary object of this invention to provide a bulk material unloader which is simple, reliable and has a fast cycle time.

It is another object of the invention to provide such an unloader which through its arrangement and construction automatically lowers the bucket into the discharge hopper to reduce dusting, thereby reducing the load on the operator, minimizing the number of starts of the hoist motor and decreasing cycle time.

Other objects will become clear from the following detailed description of specific embodiments of the invention.

SUMMARY OF THE INVENTION

According to the invention, a bulk material unloader includes a base along one end of which a container with bulk material to be unloaded, such as a vessel, can be positioned. A hopper for receiving the bulk material is supported in the base and a boom is pivoted to the base at one end for rotation about a horizontal axis which is parallel to the end of the base adjacent the container and is located between the hopper and the container. Means such as a double acting hydraulic cylinder are provided for pivoting the boom from a first side of the pivot axis wherein it extends outward over the container, through the vertical to the second side wherein it extends inward over the hopper. A clamshell bucket is supported and operated by hold and close ropes respectively reeved over sheaves mounted near the free end of the boom. The hold and close ropes are operated by hold and close hoists mounted on the base and spaced from the pivot axis of the boom in the direction of the hopper and preferably beyond the other end of the hopper from the pivot axis.

With this arrangement the loaded bucket will automatically be lowered into the hopper as the boom is swung through the vertical, not only because of the lowering of the sheaves on the free end of the boom as a result of the arc circumscribed thereby, but primarily because of the increase in the suspended length of the hold and close ropes as the boom moves in the direction of the hold and close hoists.

This automatic lowering of the bucket into the hopper for emptying can be accentuated by reeving the dead ends of the hold and close ropes over additional sheaves mounted on the free end of the boom and anchoring them to a drum located on the base on the opposite end of the hopper from the boom pivot instead of dead ending them at the boom as is conventional with clamshell buckets. Additional lowering of the bucket into the hopper without operating the hold and close hoists can be achieved by locating the hoists and/or the anchor drum above the level of the boom pivot since this further increases the suspended rope lengths as the boom pivots through the vertical toward the hopper.

Preferably, the boom is of box construction with the upper end extending diagonally out of the vertical plane of rotation through the pivot such that the sheaves carried by the free end of the boom are displaced horizontally from the boom pivot. In addition, the sheaves may be supported by a horizontal member extending from the free end of the boom. The boom may also comprise a pair of elongated members spaced along the common horizontal pivot axis with a cross member connecting the free ends of the elongated members and supporting the sheaves such that the bucket is suspended between the elongated members.

Due to the geometry of the above structure, the unloader can be operated more rapidly and with less skill and judgment required by the operator since the lowering of the bucket into the hopper occurs automatically. All the operator need do is raise the bucket and the boom to preset positions on the container side of the vertical and then as the boom is luffed through the vertical to a preset angle which vertically aligns the bucket with the hopper, the bucket will automatically descend into the hopper. The close rope is then operated to dump the load and the boom is luffed back through the vertical to the preset position on the container side. Once the bucket is raised to the preset height, which may be quickly and accurately set by the use of limit switches on the hold hoist drum, the dumping operation including lowering of the bucket into the hopper and raising it out again is accomplished without operating the hold hoist.

DESCRIPTION OF THE PREFERRED EMBODIMENTS

Figure 1:
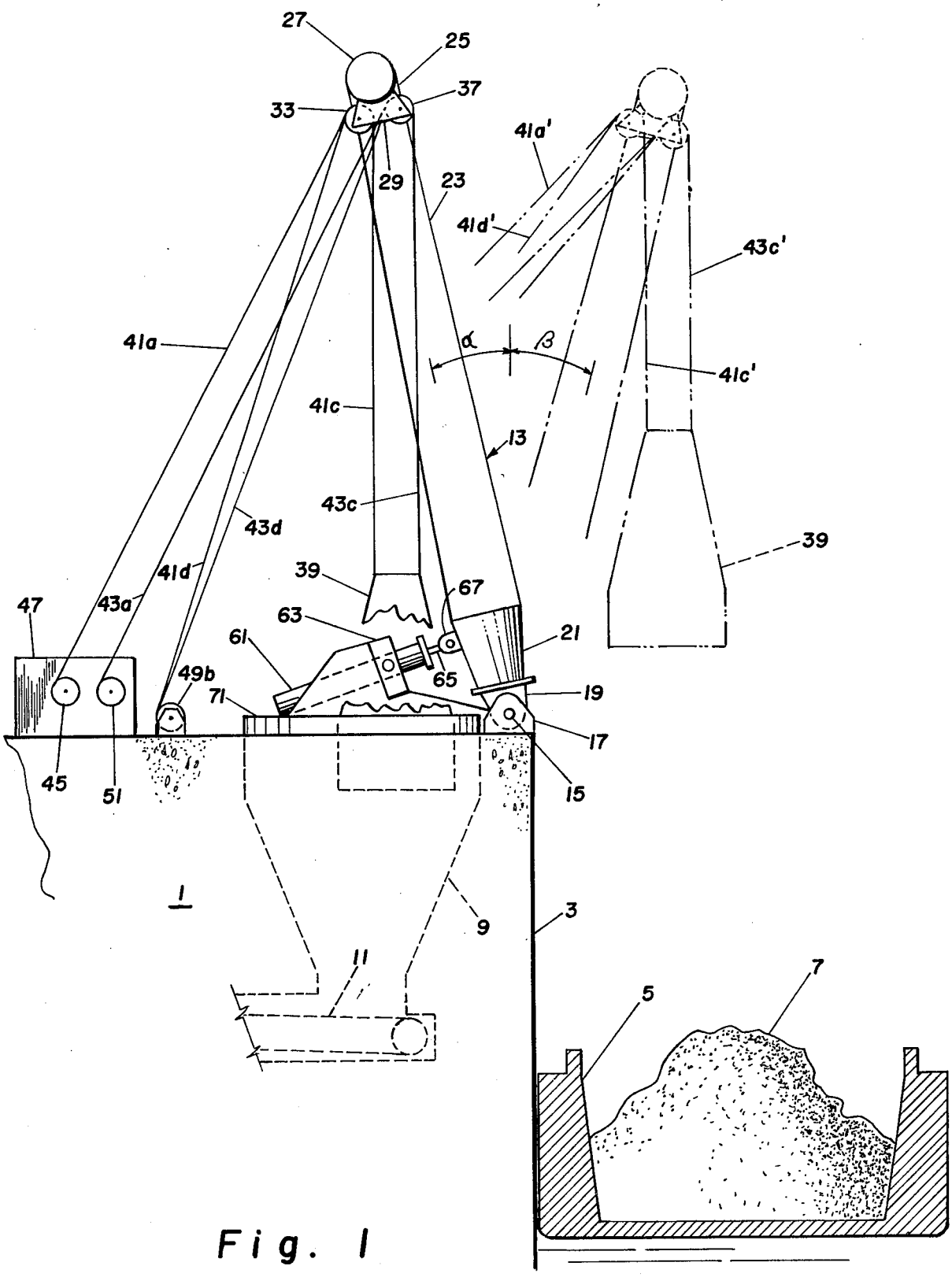
FIG. 1 is a side elevation view of an unloader according to the invention with some parts cut away for clarity and with a second position of some of the parts illustrated in dash dot lines.

FIG. 1 illustrates an unloader having a base 1 along one end 3 of which is positioned a barge 5 loaded with bulk material 7. A hopper 9 is mounted in the base 1 for receiving bulk material and depositing it on a take away conveyor 11.

Figure 2:
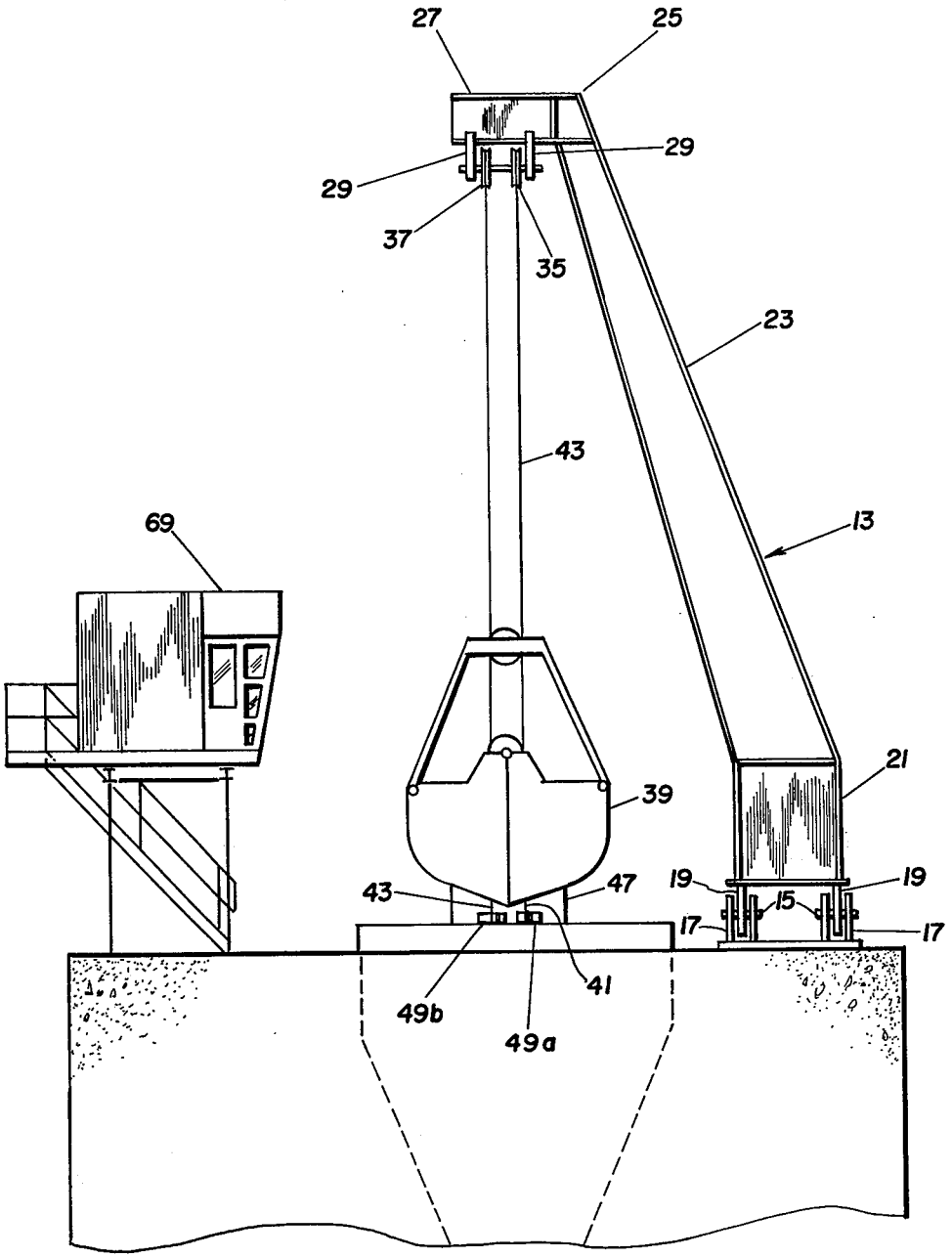
FIG. 2 is a front elevation view of the unloader of FIG. 1.

A boom 13 is pivotally mounted on the base 1 between the end 3 and the hopper 9 by horizontal shafts 15 supported by clevis mounts 17 and journalled in spaced bosses 19 on the lower end of the boom 13. The boom 13 which is of welded box construction, has an inner section 21 which extends radially outward from the horizontal axis of rotation of the boom in a vertical plane perpendicular to side 3 of the base and an outer section 23 which extends diagonally out of this vertical plane to offset the outer or free end 25 of the boom 13 horizontally from the hinged end as seen in FIG. 2. A cylindrical cross member 27 extends horizontally from the free end 25 of the boom and plates 29 depending from the cross member 27 support four sheaves 31, 33, 35 and 37.

A conventional clamshell bucket 39 is suspended from the boom 13 by hold and close ropes 41 and 43 respectively which are reeved over the sheaves mounted on plates 29. One end of the hold rope 41 is secured to hold hoist 45 in the hoist package 47 mounted on the base, and the other end is secured to the anchor drum 49*a*. Similarly, one end of the close rope is wound on close drum 51 in the hoist package 47 while the other end is secured to anchor drum 49*b*.

Figure 3:
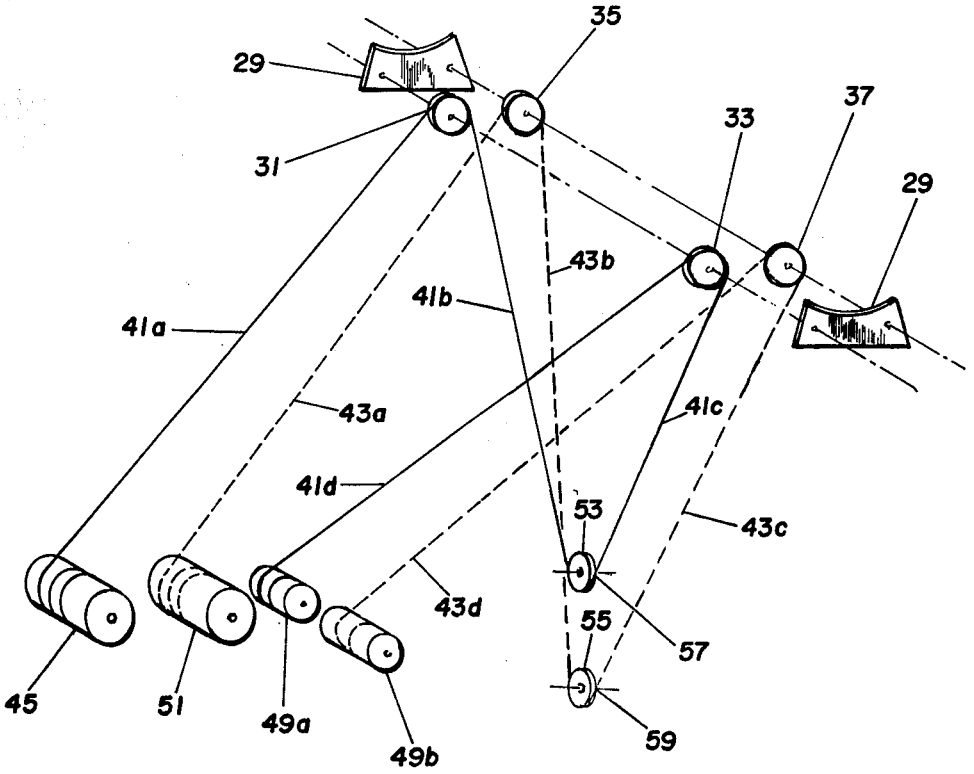
FIG. 3 is an exploded isometric view schematically illustrating the reeving of the hold and close ropes of the unloader shown in FIGS. 1 and 2.

The reeving scheme can best be understood by referring to FIG. 3 wherein the hold rope 41 is displayed as a solid line and the close rope 43 is shown as a dashed line for clarity. Sections of the ropes between the various sheaves and drums are identified by the appropriate numeral followed by a letter which will be specifically referred to in the discussion below. The hold rope 41 is wound on the hold hoist 45 and is reeved over sheave 31 mounted between support plates 29, under hold sheave 53 on the bucket 39, up over sheave 33 on the boom and then down to anchor drum 49*a* where it is dead ended. Close rope 43 is wound on close hoist 51 and is reeved over sheave 35 between support plates 29, under close sheave 55 on the bucket 39, up over sheave 37 on the boom and then down to anchor drum 49*b*. Thus, the bucket 39 is suspended in the bights 57 and 59 respectively of the ropes 41 and 43.

The boom 13 is luffed in the vertical plane about the pivot axis formed by shafts 15 by a double acting hydraulic cylinder 61 which is rotatably secured in trunion mounting 63 on the base 1 with the cylinder rod 65 pivotally connected to the boom by clevis 67. By operation of the hydraulic cylinder, the boom 13 can be luffed from the position shown in solid lines in FIG. 1 through the vertical to a desired angular position on the barge side of the pivot axis, such as the position shown in dash dot lines in the Figure.

In operation, the operator, located in the cab 69, adjusts the angle that the boom extends outward over the barge 5 to vertically align the clamshell bucket 39 with the portion of the load of bulk material to be transferred. Through operation of the hold and close hoists 45 and 51 respectively, the bucket is lowered into the pile and loaded with bulk material in conventional fashion which is well known. The bucket is then raised by the operator and the angle that the boom makes with the vertical is adjusted to maneuver the bucket and boom to the position shown in the dash dot lines in FIG. 1. As previously mentioned, proper positioning of the ropes and the boom can be effected by limit switches. From this position shown in dash dot lines in FIG. 1, the boom is luffed by hydraulic cylinder 61 through the vertical to the position shown in solid lines over the hopper 9. As the boom is luffed, the bucket is automatically lowered without operation of the hoists to the position shown in the left side of FIG. 1 wherein the bucket is inside the hopper 9.

The lowering of the bucket 39 as the boom 13 is luffed counterclockwise in FIG. 1 is attributable to the fact that the suspended length of the hold and close ropes 41 and 43 respectively increases during this movement. From FIG. 3 it can be seen that the effective length of the hold rope 41 includes the segments 41*a*, 41b, 41*c*, and 41*d*. Since the hoist 45 is not operated while the boom is luffed through the vertical, the total effective length of the rope 41 remains the same for the two positions of the boom shown in FIG. 1. However, it is evident from the figure that the section 41*a*when the boom 13 makes an angle $\alpha$ with the vertical is substantially shorter than the section 41*a*' when the boom makes an angle $\beta$ on the barge side of the vertical. Similarly, the section 41*d* between the anchor 49 and the sheave 33 is less than the length 41*d*'. The difference in length between sections 41*a* plus 41*d* and sections 41*a*' plus 41*d*' accounts for the greater length of the suspended sections 41*b* and *c* over 41*b*' and *c*'. A similar lengthening of the suspended sections 43*b* and *c* of the close rope occurs as the boom is luffed over the hopper.

While the suspended sections of the ropes begin to lengthen as soon as the boom begins counterclockwise rotation, this lengthening of the suspended sections of the ropes is initially offset to some extent by the raising of the supporting sheaves as the boom approaches the vertical. After the boom passes through top center, the lowering of the sheaves on top of the boom adds to the lengthening of the suspended rope sections as the boom moves toward the hoist and anchor drums and the bucket drops rapidly into the hopper. Thus the bucket may be lowered a substantial distance into the hopper so that dusting is minimized when the close hoist is operated to open the bucket, yet the bucket still clears the base and the edge of the hopper 9 even when the latter is provided with a raised edge such as 71.

After emptying of the bucket 39 in the hopper 9, the boom is luffed back through the vertical to the position shown in dash-dot lines in FIG. 1. As the boom is luffed in the clockwise direction, the effective shortening of the rope sections 41*b* and *c* and 43*b* and *c* rapidly raises the bucket out of the hopper so that it clears the side of the hopper and the base. From the position shown in dash-dot lines, the angle of the boom and the total effective length of the ropes 41 and 43 can be adjusted by the operator to refill the bucket with bulk material in the barge.

Since the lowering of the bucket into the hopper is effected by the geometry of the reeving scheme, the unloader dumping cycle can be easily automated. Thus once the operator positions the boom and bucket as shown in dash-dot lines in FIG. 1, activation of a dump control luffs the boom to assume the angle $\alpha$ with the vertical, operates the close hoist and then luffs the boom back to the angle $\beta$ with the vertical. This can significantly lower the cycle time and remove the factor of operator judgment from the dump cycle.

Figure 4:
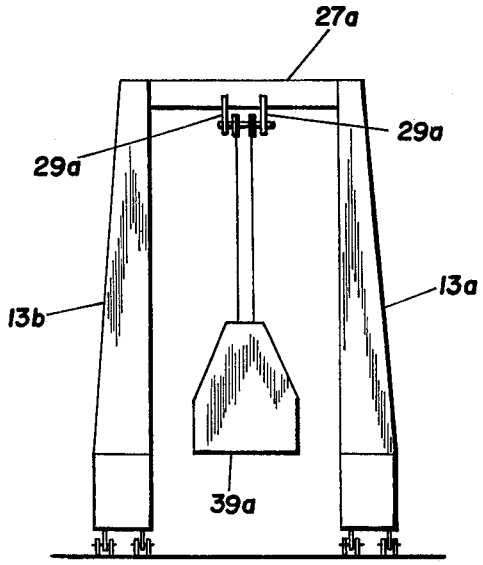
FIG. 4 is a front elevation of a modified form of the invention.

Alternatively, as shown in FIG. 4, the boom may comprise two hinged elongated box structures 13*a* and *b* pivoted on a common axis and joined at the free ends by a cross member 27*a* from which the sheaves for the hold and close ropes are rotatably suspended on support plates 29*a*. The structure may be luffed by hydraulic cylinders (not shown) pivotally connected to each of the elongated members 13*a* and *b* in the manner discussed above.

It can be appreciated that raising the height of the hoists and/or the height of the anchor drum will increase the distance that the bucket descends into the hopper 9 since it increases the difference in the suspended lengths of ropes 41 and 43 between the two angular positions of the boom shown in FIG. 1. Similarly, it can be realized that interchanging relative positions of the hoists and anchor drums permits additional changes in suspended rope lengths. It can further be appreciated that in some installations, the dead ends of the hold and close ropes 41 and 43 respectively may be anchored to plates 29 at the top of the boom 13 rather than to anchor drums 49*a* and 49*b* and there will still be sufficient difference in the suspended lengths of the ropes to lower the bucket into the hopper.

While the invention has been specifically described by reference to particular, preferred embodiments, it is to be understood that such description is intended to illustrate rather than limit the invention which is defined by the appended claims.

We claim:

1. A bulk material unloader comprising:

a base along one side of which a container of bulk material is positioned for unloading;

a bulk material receiving hopper mounted in said base;

a boom hinged at one end to the base for rotation about a horizontal pivot axis which is parallel to said one side of said base and located between said hopper and the one side of the base;

means for pivoting said boom from a first side of said horizontal pivot axis wherein the boom extends outward over the container to be unloaded, through the vertical to a second side wherein the boom extends inward over the hopper;

a clamshell bucket;

hold and close ropes for supporting and operating said clamshell bucket respectively;

sheaves rotatably mounted near the free end of said hinged boom and over which said hold and close ropes are reeved; and hold and close hoists for operating said hold and close ropes respectively mounted on said base and spaced from the pivot axis of said boom in the direction of said hopper.

2. The unloader of claim 1 wherein said hold and close drums are mounted on said base beyond the hopper.

3. The unloader of claim 1 including additional sheaves rotatably mounted near the free end of the hinged boom and anchors on said base spaced from said hinged boom pivot axis in the direction of said hopper, said hold and close ropes being reeved over said additional sheaves and dead ended at said anchors with said clamshell bucket suspended in the bights thus formed in the hold and close ropes.

4. The unloader of claim 3 wherein said anchors are secured to said base at points beyond the hopper.

5. The unloader of claim 1 wherein said hoists are spaced vertically above as well as horizontally from the boom pivot point.

6. The unloader of claim 3 wherein said anchors are spaced vertically above as well as horizontally from the boom pivot point.

7. The unloader of claim 1 wherein an elongated outer portion of said boom extends diagonally out of the vertical plane of rotation passing through the boom pivot to offset the sheaves horizontally from the boom pivot.

8. The unloader of claim 1 or 7 including a support member extending horizontally from the free end of the boom for supporting said sheaves.

9. The unloader of claim 1 wherein said boom comprises a pair of elongated members spaced along the common horizontal pivot axis with a cross member joining the free ends thereof and supporting said sheaves.

10. A method of operating a bulk material unloader in which a clamshell bucket is suspended by hold and close ropes from the free end of a boom pivoted on a base for movement through the vertical about a point located between the barge to be unloaded and a hopper and wherein hoists for said hold and close ropes are mounted on the base and spaced from the boom pivot a substantial distance in the direction of the hopper, said method comprising: p1 pivoting the boom to position the clamshell bucket over the container to be unloaded;

operating the hold and close hoists to lower the bucket and fill it with bulk material from the container;

operating said hoists and pivoting said boom to raise the bucket to a preset height above the boom pivot with the boom set at a preset angle with the vertical on the container side of the pivot;

pivoting the boom through the vertical without operation of the hoists to vertically align the bucket with and to lower it partially into the hopper;

operating the close hoist to discharge the bulk material in the hopper; and pivoting the boom back through the vertical to said preset angle to reposition said bucket at said preset position from which the cycle can be repeated.

* * * * *